United States Patent [19]

Yamanaka

[11] 3,930,925

[45] Jan. 6, 1976

[54] MASTER PLATE TREATING DEVICE FOR A DUPLICATING MACHINE

[75] Inventor: Masanori Yamanaka, Tokyo, Japan

[73] Assignee: Ricoh Co., Ltd., Tokyo, Japan

[22] Filed: Oct. 7, 1974

[21] Appl. No.: 512,993

[30] Foreign Application Priority Data

Oct. 18, 1973 Japan ..... 48-117285

[52] U.S. Cl. ..... 156/345; 156/14

[51] Int. Cl.[2] ..... C23F 1/02

[58] Field of Search ..... 96/36.3, 37; 101/337; 156/8, 14, 345

[56] References Cited

UNITED STATES PATENTS

| | | | |
|---|---|---|---|
| 2,604,024 | 7/1952 | Luboshez | 156/345 X |
| 2,803,078 | 8/1957 | Coughlin | 156/345 |
| 3,647,596 | 3/1972 | Thate et al. | 156/345 |

*Primary Examiner*—William A. Powell

*Attorney, Agent, or Firm*—Cooper, Dunham, Clark, Griffin & Moran

[57] ABSTRACT

A device for giving a desensitizing or so-called ink-repellent etching treatment in addition to a fixing/and or a drying treatment to a master plate which has been developed but not fixed yet when such master plate is prepared by an electrophotographic copying apparatus. As soon as the master plate is developed and brought to a position for introduction into the device, the device is automatically rendered operative to introduce the master plate into the device and subject the same to necessary treatments before automatically ejecting it from the device.

4 Claims, 7 Drawing Figures

MASTER PLATE TREATING DEVICE FOR A DUPLICATING MACHINE

BACKGROUND OF THE INVENTION

This invention relates to a master plate treating device.

In an offset duplicating machine, a master plate wound on the master cylinder is treated with a desensitizing or so-called ink-repellent etching solution so that no ink may be applied to regions of the plate other than the region of the image thereon, ink is supplied to the etched master plate to form an ink image which is transferred to the blanket cylinder, and the ink image formed on the blanket cylinder is transferred to sheets by pressing each sheet between the blanket cylinder and the impression cylinder, whereby a number of copies of the master plate can be produced. Since the etching solution is liable to cause erosion of components of the duplicating machine, it is desirable that the etching solution be removed from the main body of the duplicating machine and each master plate is treated with an etching solution each time it is prepared by an electrophotographic copying apparatus. To this end, a master plate prepared by the electrophotographic copying apparatus is preferably treated beforehand with an etching solution, the etching solution is dried, and water is applied to the master plate when printing is carried out so as to restore the etching solution to an active state.

The practice of preparing master plates for offset duplicating machines by an electrophotographic copying apparatus has become popular. As a final step of preparing of a master plate, the developed image is heated for fixing the same in a copying machine when using a dry developing agent, and the developing liquid adhering to the master plate is dried in a copying apparatus when using a liquid developing agent. Thus, the master plate treatment device should be of a construction such that heating the master plate after developing, applying an etching solution to the master plate and drying the applied etching solution can be performed by a simple mechanism.

SUMMARY OF THE INVENTION

This invention has as its object the provision of a master plate treating device which automatically subject a master plate just developed to etching and other necessary treatments whereby the master plate can be readily used with a duplicating machine.

DESCRIPTION OF A PREFERRED EMBODIMENT

Figure 1:
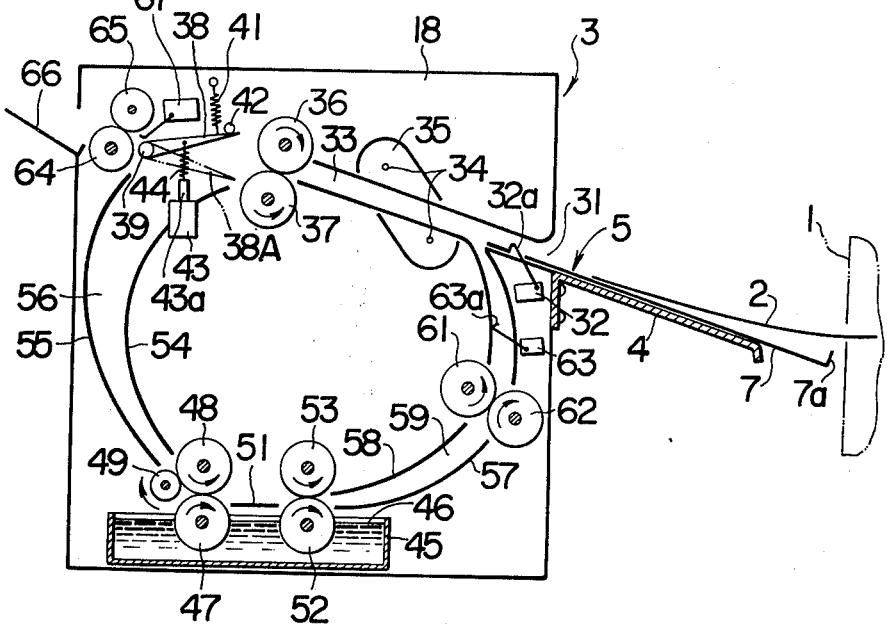
FIG. 1 is a front view of the master plate treating device comprising one embodiment of the invention.

Referring to FIG. 1, a master plate 2 that has been processed through the developing step in an electrophotographic copying apparatus 1 is ejected onto a master plate feed tray 4 secured at its base to a main body or housing of a master plate treating device 3. Arranged on the master plate feed tray 4 is delivery means 5 shown in detail in FIG. 2 which comprises a member 6 of a relatively thick wire including a transverse portion and two parallel portions 6*a* and 6*b* extending axially forwardly from opposite ends of the transverse portion, a pair of arms 7 and 8 secured at their bases to the member 6 and extending axially rearwardly, and a connector 9 interconnecting the arms 7 and 8 at their free ends portions. The arms 7 and 8 are formed at their free end portions with upwardly bent portions 7*a* and 8*a* respectively which are adapted to engage the trailing end of the master plate 2. The parallel portions 6*a* and 6*b* of the member 6 loosely extend through immovable guides 11 and 12 respectively. The parallel portion 6*a* is formed at a free end thereof with a downwardly bent portion 6*c* (See FIG. 4) which is formed at its lower free end with a bifurcated portion 6*d* which loosely receives therein a pin 13 affixed to a movable plate 14 secured to a pair of pins constituting the elements of a chain 15 at one side of the chain 15.

The chain 15 is trained over a pair of sprocket wheels 16 and 17 (See FIG. 2) which are secured to one end of shafts 19 and 21 respectively which in turn are rotatably supported by an immovable side plate (See FIG. 1). The shafts 19 and 21 have secured at the other end thereof sprocket wheels 22 and 23 respectively over which a chain 24 is trained. A pin 26 is affixed to a movable plate 25 which is secured at its base to the chain 24 loosely received in a bifurcated portion (not shown) formed at a lower end of a downwardly bent portion of the other parallel portion 6*b* of the member 6.

Figure 3:
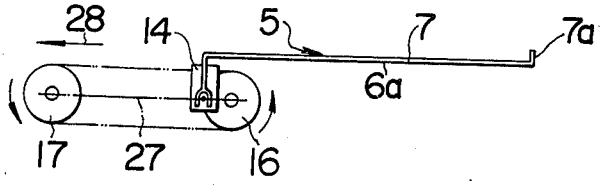
FIG. 3 is a view of the mechanism shown in FIG. 2 as seen in the direction of arrows A—A.
Figure 4:
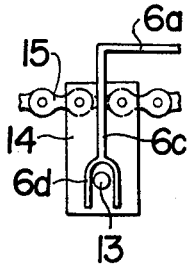
FIG. 4 is a front view showing a connecting portion of the delivery means shown in FIG. 2.

Referring to FIG. 3 and FIG. 4, the pin 13 affixed to the movable plate 14 is disposed on or near a line 27 interconnecting the center axes of the two sprocket wheels 17 and 16. Thus, as the movable plate 14 moves with the chain 15 in the direction of an arrow 28, the delivery means 5 moves leftwardly and rightwardly in reciprocatory movement in FIG. 3. The rotation of the shafts 19 and 21 supporting the sprockets and the interruption of rotation thereof are controlled by a clutch mechanism 81 subsequently to be described.

Referring to FIG. 1 again, a first switch 32 is arranged on the master plate feed tray 4 near a master plate inlet 31 and senses the presence of a master plate on the master plate feed tray 4. Heating means 35 comprising lamps 34 is disposed midway along a master plate passageway 33 extending from the inlet 31 into the device 3. The heating means 35 performs the function of fixing a toner image which is formed on the master plate 2 but not yet fixed when the electrophotographic copying apparatus 1 is of the type which employs a dry developing agent, and the function of drying the developing liquid adhering to the master plate 2 when the apparatus 1 is of the type using a liquid developing agent.

A first pair of rotatable feed rollers 36 and 37 maintained in pressing engagement with each other and a switch plate 38 are arranged on the left end of the passageway 33 in FIG. 1. The switch plate 38 which is pivotally supported at its base through a shaft 39 secured by an immovable member is normally urged to move counterclockwise about the shaft 39 in FIG. 1 by the biasing force of a compression spring 41 connected at one end to the immovable member and at the other end to the switch plate 38, so that the switch plate 39 is normally maintained at its free end in engagement with a stopper 42 as shown in solid lines in the figure. The switch plate 38 is connected through a spring 44 to an actuator 43*a* of a solenoid 43 secured to an immovable member. Upon energization of the solenoid 43, the switch plate 38 is moved to a dash-and-dot line position 38A against the biasing force of spring 41.

Arranged on the bottom of the treating device 3 is an etching solution tank 45 containing therein a desensitizing or so-called ink-repellent etching solution 46. An etching solution applying roller 47 whose outer periphery is immersed in part in the etching solution 46 is maintained in pressing engagement with one roller 48 of a second pair of feed rollers 48 and 49. The applying roller 47 which is made of felt or other soft material has a peripheral velocity which is higher than that of the feed roller 48. This enables an etching solution to be applied to the master plate 2 with a high degree of efficiency.

A guide plate 51 and a pair of squeeze rollers 52 and 53 are arranged rightwardly of the applying roller 47 in FIG. 1. Guide plates 54 and 55 interposed between the first pair of feed rollers 36 and 37 and the second pair of feed rollers 48 and 49 define therebetween a passageway 56, while guide plates 57 and 58 interposed between the pair of squeeze rollers 52 and 53 and the heating means define therebetween a passageway 59. A third pair of feed rollers 61 and 62 and a second switch 63 are arranged in the passageway 59, with the second switch 63 being operative to energize the solenoid 43.

A pair of ejecting rollers 64 and 65 and an ejected master plate receiving tray 66 are arranged leftwardly of the switch plate 38 in FIG. 1. A third switch 67 for detecting the trailing end portion of the master plate 2 is disposed between the switch plate 38 and the pair of ejecting rollers 64 and 65.

Figure 2:
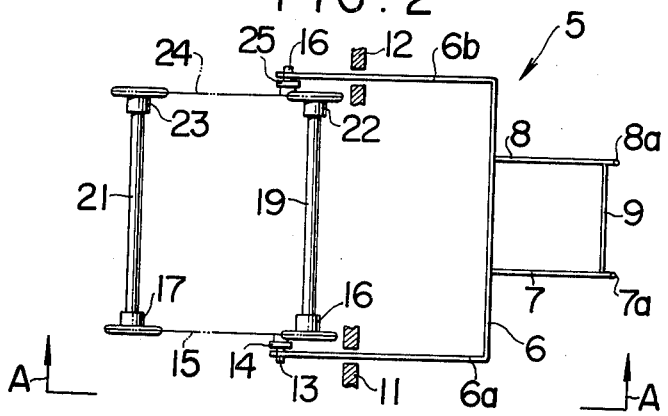
FIG. 2 is a plan view of a delivery means and a delivery means operating section of the device.
Figure 6:
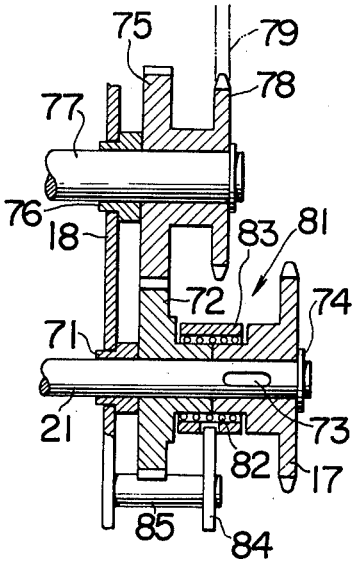
FIG. 6 is a front view of a clutch mechanism of the device.

The shaft 21 supporting the sprocket wheels 17 and 23 at opposite ends thereof as shown in FIG. 2 is loosely supported at one end portion thereof through a bearing 71 by a side plate 18 as shown in FIG. 6. A follower gear 72 is rotatably mounted on, and the sprocket wheel 17 is keyed at 73 to, an end portion of the shaft 21 which extends outwardly (rightwardly in FIG. 6) of the side plate 18. A ring 74 is secured to the end of the extension of the shaft 21 to prevent dislodging of the sprocket wheel 17. Maintained in meshing engagement with the follower gear 72 is a drive gear 75 which is secured to a shaft 77 rotatably supported by the side plate 18 through a bearing 76. Formed integrally with the drive gear 75 is a sprocket wheel 78 which is connected to a drive source (not shown) by a chain 79 and normally driven to rotate clockwise as seen from the right in FIG. 6.

Figure 7:
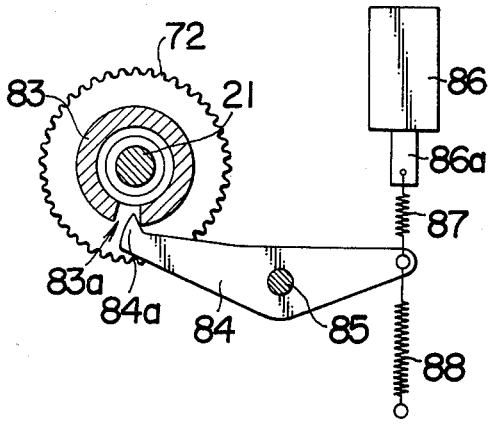
FIG. 7 is a right side view of the clutch mechanism shown in FIG. 6.
Figure 5:
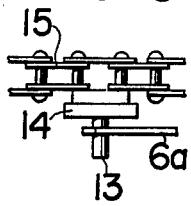
FIG. 5 is a plan view of the connecting portion shown in FIG. 4.

Interposed between the follower gear 72 and the sprocket wheel 17 is the spring clutch mechanism 81 which comprises a spring 82 mounted on a boss of the gear 72 and a boss of the sprocket wheel 17, and a sleeve 83 which is disposed outwardly of the spring 82 to enclose the same. The spring 82 is connected at one end to the sleeve 83 and at the other end to the sprocket wheel 17. The sleeve 83 is formed in its periphery with an opening 83*a* in which a claw 84*a* formed at a free end of an actuating lever 84 can be engaged to prevent the rotation of the sleeve 83 as shown in FIG. 7. That is, the spring clutch mechanism 81 is brought to an off-position as the claw 84*a* is engaged in the opening 83*a* to preclude the rotation of the sleeve to thereby prevent the winding of the spring 82 on the boss of the follower gear 72. When the clutch mechanism 81 is in its off position, the rotation of the follower gear 72 is not transmitted to the sprocket wheel 17.

Referring to FIG. 7, the actuating lever 84 is pivotally connected through a shaft 85 to the side plate 18 and has an end portion (the right end portion in FIG. 7) which is connected through a spring 87 to an actuator 86*a* of a solenoid 86 secured to the side plate 18. The actuating lever 84 is urged to move clockwise about shaft 85 in FIG. 7 by the biasing force of a compression spring 88 connected at one end to the right end portion of the lever 84 and at the other end to an immovable member. The clockwise rotation of the lever 84 is precluded by the left end of the lever 84 being maintained in engagement with the sleeve 83.

The operation of the device constructed as aforementioned will now be described. In FIG. 1, the master plate 2 processed through the developing step by the electrophotographic copying apparatus 1 of the type using either a dry or liquid developing agent is ejected onto the delivery means 5 on the master plate feed tray, and presses at its leading end the actuator 32*a* of the first switch 32 to turn on the same. When the first switch 32 is brought to an on-position, the master plate 2 is bodily placed on the delivery means 5, with its trailing end being engaged by the upwardly bent portions 7*a* and 8*a* of the delivery means 5.

When brought to its on-position, the first switch 32 energizes the solenoid 86 shown in FIg. 7 and causes the actuating lever 84 to move counterclockwise in pivotal motion about shaft 85 in the figure to release the sleeve 83. Upon the sleeve 83 being released, the spring 82 is wound tightly on the boss of the follower gear 72, thereby turning on the spring clutch mechanism 81 and transmitting the rotation of the follower gear 72 to the sprocket wheel 17 and shaft 21. As a result, the chains 15 and 24 shown in FIG. 2 move counterclockwise as seen in the direction of arrows A-A in the figure or in the direction of the arrow 28 in FIG. 3. This moves the movable plates 14 and 25 and the delivery means 5 leftwardly in FIG. 2, thereby delivering the master plate 2 to the passageway 33.

While the master plate 2 is being thus delivered, it is heated by the heating means 35. Then, the master plate 2 is delivered to the passageway 56 by the first feed rollers 36 and 37 rotating in the directions of arrows. When the master plate moving through the passageway 56 is delivered rightwardly in FIG. 1 by the second pair of feed rollers 48 and 49, the etching solution 46 in the tank 45 is applied to an image on the master plate 2 by the applying roller 47. After having excess etching solution removed from its surface by the pair of squeeze rollers 52 and 53, the master plate 2 is returned to the passageway 33 by the third pair of feed rollers 61 and 62. By forming a closed path by the passageways 33, 56 and 59 along which the heating means 35 and the etching solution applying roller 47 are arranged, it is possible to heat the master plate 2 again to dry the etching solution applied thereto. When the master plate 2 is passed on from passageway 59 to passageway 33, it depresses the actuator 63*a* of the second switch 63 to bring the same to an on-position.

Upon the second switch 63 being turned on, solenoid 43 is energized and moves the switch plate 38 from the solid line position to the dash-and-dot line position 38A. Thus, the master plate 2 which has passed by the heating means 35 for the second time is ejected by the first pair of feed rollers 36 and 37 and the pair of ejection rollers 64 and 65 onto the ejected master plate receiving tray 66. Solenoid 67 is de-energized when the trailing end portion of the master plate 2 is detected by the third switch 67, thereby permitting the switch plate 38 to be restored to the solid line position by the biasing force of spring 42.

On the other hand, when the movable plate 14 shown in FIG. 3 moves through its path with the chain 15 and returns to its original position, a switch (not shown) is turned on and de-energizes the solenoid 86 shown in FIG. 7. This permits the actuating lever 84 to be moved clockwise in pivotal motion about shaft 85 by the biasing force of spring 88, so that the claw 84*a* is brought into engagement in the opening 83*a* to lock the sleeve 83. Thus, the spring clutch mechanism 81 is brought to an off-position and the delivery means 5 stops in its original position on the master plate feed tray 4.

What is claimed is:

1. A master plate treating device comprising:

a closed path having an inlet for introducing a developed master plate therethrough into the closed path and an outlet for discharging said master plate from the closed path after subjecting the same to selected treatments and permitting the master plate to move therethrough;

heating means mounted in one portion of said closed path interposed between said inlet and said outlet for heating the master plate passing through said one portion of the closed path;

ink-repellent etching solution applying means mounted in another portion of said closed path interposed between said inlet and said outlet for applying an ink-repellent etching solution to the master plate passing through said another portion of the closed path;

means disposed in the vicinity of said outlet for switching the master plate between two directions, one direction leading to said outlet and the other direction permitting the master plate to move further on in said closed path; and means for controlling said for switching the master plate.

2. A device as in claim 1 further comprising means disposed outside said inlet for introducing a master plate into said closed path through the inlet when the master plate is brought to a stand-by position for entrance into the closed path after being developed.

3. A device as in claim 2 further comprising means for rendering the treating device operative when the developed master plate is brought to said stand-by position.

4. A device as in claim 2 wherein said introducing means comprises a delivery member adapted to move in reciprocating motion and to engage a trailing end of the master plate to deliver the same into the closed path through the inlet.

* * * * *